US007143965B2

(12) United States Patent
Lindner et al.

(10) Patent No.: US 7,143,965 B2
(45) Date of Patent: Dec. 5, 2006

(54) FUEL SUPPLY FOR INTERNAL COMBUSTION ENGINES

(75) Inventors: Michael Lindner, Leutenbach (DE); Juergen Bauer, Grossbottwar (DE); Martin Zimmer, Marbach (DE); Claus Westphal, Grossbottwar (DE); Alexander Redlich, Leinfelden-Echterdingen (DE); Ruediger Bohnsack, Litzendorf (DE); Peter Rehbein, Weissach (DE); Juergen Hackenberg, Sachsenheim (DE); Georg Ketteler, Bamberg (DE); Marcus Rinke, Ludwigsburg (DE); Jochen Straehle, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 115 days.

(21) Appl. No.: 10/363,739

(22) PCT Filed: Jul. 4, 2002

(86) PCT No.: PCT/DE02/02443

§ 371 (c)(1),
(2), (4) Date: Sep. 15, 2003

(87) PCT Pub. No.: WO03/004865

PCT Pub. Date: Jan. 16, 2003

(65) Prior Publication Data

US 2004/0079818 A1 Apr. 29, 2004

(30) Foreign Application Priority Data

Jul. 7, 2001 (DE) ..... 101 33 166

(51) Int. Cl.
*F02M 59/00* (2006.01)
*F02M 61/10* (2006.01)
*F02M 61/00* (2006.01)
*B05B 1/30* (2006.01)

(52) U.S. Cl. ..... 239/533.2; 239/533.11; 239/533.12; 239/585.1; 239/585.4; 239/585.5; 239/88

(58) Field of Classification Search ..... 239/533.1, 239/533.2, 533.11, 533.12, 585.1, 585.3, 239/585.4, 585.5, 88–93; 251/129.15, 129.21, 251/127

See application file for complete search history.

(56) References Cited

U.S. PATENT DOCUMENTS

| | | | | |
|---|---|---|---|---|
| 3,677,256 | A * | 7/1972 | Regneault et al. | 123/503 |
| 3,721,163 | A | 3/1973 | Hill et al. | |
| 3,722,801 | A | 3/1973 | Chapuis | |
| 5,230,615 | A | 7/1993 | Yoshino et al. | |
| 5,544,816 | A * | 8/1996 | Nally et al. | 239/585.5 |
| 5,678,767 | A * | 10/1997 | Rahbar | 239/533.2 |
| 5,921,475 | A * | 7/1999 | DeVriese et al. | 239/585.4 |

(Continued)

FOREIGN PATENT DOCUMENTS

DE 198 20 264 A1 11/1999

(Continued)

*Primary Examiner*—Davis Hwu
(74) *Attorney, Agent, or Firm*—Ronald E. Greigg

(57) ABSTRACT

A fuel supply system, having a housing, in which a piston-like element is disposed longitudinally displaceably in a bore and is guided sealingly in the bore by a guide portion. On one end, the guide portion adjoins a first fuel-filled chamber, and on its other end it adjoins a second fuel-filled chamber. At least one recess extending at least approximately in the circumferential direction is embodied in the guide portion of the pistonlike element and extends over at least part of the circumference of the pistonlike element and, viewed in the longitudinal direction of the pistonlike element, has an asymmetrical cross section.

19 Claims, 3 Drawing Sheets

U.S. PATENT DOCUMENTS

| | | | | |
|---|---|---|---|---|
| 6,003,791 | A * | 12/1999 | Reiter | 239/575 |
| 6,039,271 | A * | 3/2000 | Reiter | 239/585.4 |
| 6,283,389 | B1 | 9/2001 | Hofmann | |
| 6,575,428 | B1 * | 6/2003 | Stier et al. | 251/129.15 |

FOREIGN PATENT DOCUMENTS

| | | |
|---|---|---|
| DE | 198 43 344 A1 | 3/2000 |
| EP | 0 534 771 A1 | 3/1993 |
| GB | 1009159 | 11/1965 |

* cited by examiner

FUEL SUPPLY FOR INTERNAL COMBUSTION ENGINES

CROSS-REFERENCE TO RELATED APPLICATIONS

This application is a 35 USC 371 application of PCT/DE 02/02443 filed on Jul. 2, 2002.

BACKGROUND OF THE INVENTION

1. Field of the Invention

The invention is directed to an improved fuel supply system for internal combustion engines.

2. Description of the Prior Art

One fuel supply system of the type with which this invention is concerned. known for instance from German Patent Disclosure DE 198 20 264 A1. has a housing in which a pistonlike element is disposed longitudinally displaceably in a bore. The pistonlike element, which can be embodied as a valve needle, for instance, is guided sealingly in the bore in a guide portion of the bore. On one end of the guide portion, a first fuel-filled chamber adjoins the guide portion, and on the other end of the guide portion, a second fuel-filled chamber adjoins it. Because of the sealing guidance, only severely throttled fuel can flow from one fuel-filled chamber into the other through the annular gap formed between the pistonlike element and the wall of the bore, and in the annular gap the fuel forms a lubricating film.

In the fuel supply system, which can for instance be a fuel injection valve for internal combustion engines, the pistonlike element moves in the bore in the longitudinal direction. The result can be wear between the pistonlike element and the wall of the bore. To minimize wear, especially whenever a pressure difference prevails between the first fuel-filled chamber and the second fuel-filled chamber, various provisions are known, such as various kinds of structuring and coatings of the pistonlike element. In DE 198 20 264 A1, flutelike grooves on the guide portion of the pistonlike element are shown, which are embodied there at various depths and with various widths and in various arrangements. However, this does not take into account the fact that the first and second fuel-filled chambers of the fuel supply system are not the same in their function and in terms of the pressures that occur there, and that the pistonlike element for instance moves at different speeds in the two longitudinal directions. As a result, the lubricating film between the guide portion of the pistonlike element and the wall of the bore is not always embodied optimally.

SUMMARY OF THE INVENTION

The fuel supply system of the invention for internal combustion engines has the advantage over the prior art that between the guide portion of the pistonlike element and the wall of the bore, an optimal fuel lubricating film is always formed, which minimizes the friction of the pistonlike element in the bore. For this purpose, at least one recess, which extends over at least part of the circumference of the component, extends at least approximately in the tangential direction along the guide portion of the pistonlike element. In the longitudinal direction of the component, the recess has an asymmetrical cross section, so that the various conditions that can prevail upon the motion of the pistonlike element in one longitudinal direction and the other are taken into account.

In an advantageous feature of the subject of the invention, the recess has a V-shaped cross section, viewed in the longitudinal direction of the pistonlike element, and one flank of the cross section is shorter than the other. Depending on the orientation of the flanks relative to the longitudinal direction of the pistonlike element, an optimization of the lubricating properties can be achieved in the annular gap between the pistonlike element and the wall of the bore.

In a further advantageous feature, a plurality of recesses, each with a V-shaped cross section, are formed in the pistonlike element, and the shorter flanks, from one recess to the next, are oriented in alternation toward the first and the second chamber. This arrangement has proved to be advantageous in certain configurations in terms of the pressure and operation in the engine.

In a further advantageous feature, the transition from the surface of the guide portion of the pistonlike element to the shorter flank of the recess is embodied with a sharp edge, while the transition from the surface of the pistonlike element to the longer flank of the V-shaped recess is rounded. With this embodiment of the transitions, further optimization of the lubricating properties can be achieved.

In an advantageous feature, the flanks of the V-shaped recess have a length of from 0.03 mm to 1 mm. This microstructuring makes it possible to adapt the lubricating properties to high-precision guides of the pistonlike element, of the kind used for instance in fuel injection valves used for self-igniting internal combustion engines.

BRIEF DESCRIPTION OF THE DRAWINGS

Further advantages and advantageous features of the invention can be learned from the detailed description contained herein below, taken with the drawings. in which.

DESCRIPTION OF THE PREFERRED EMBODIMENTS

Figure 1:
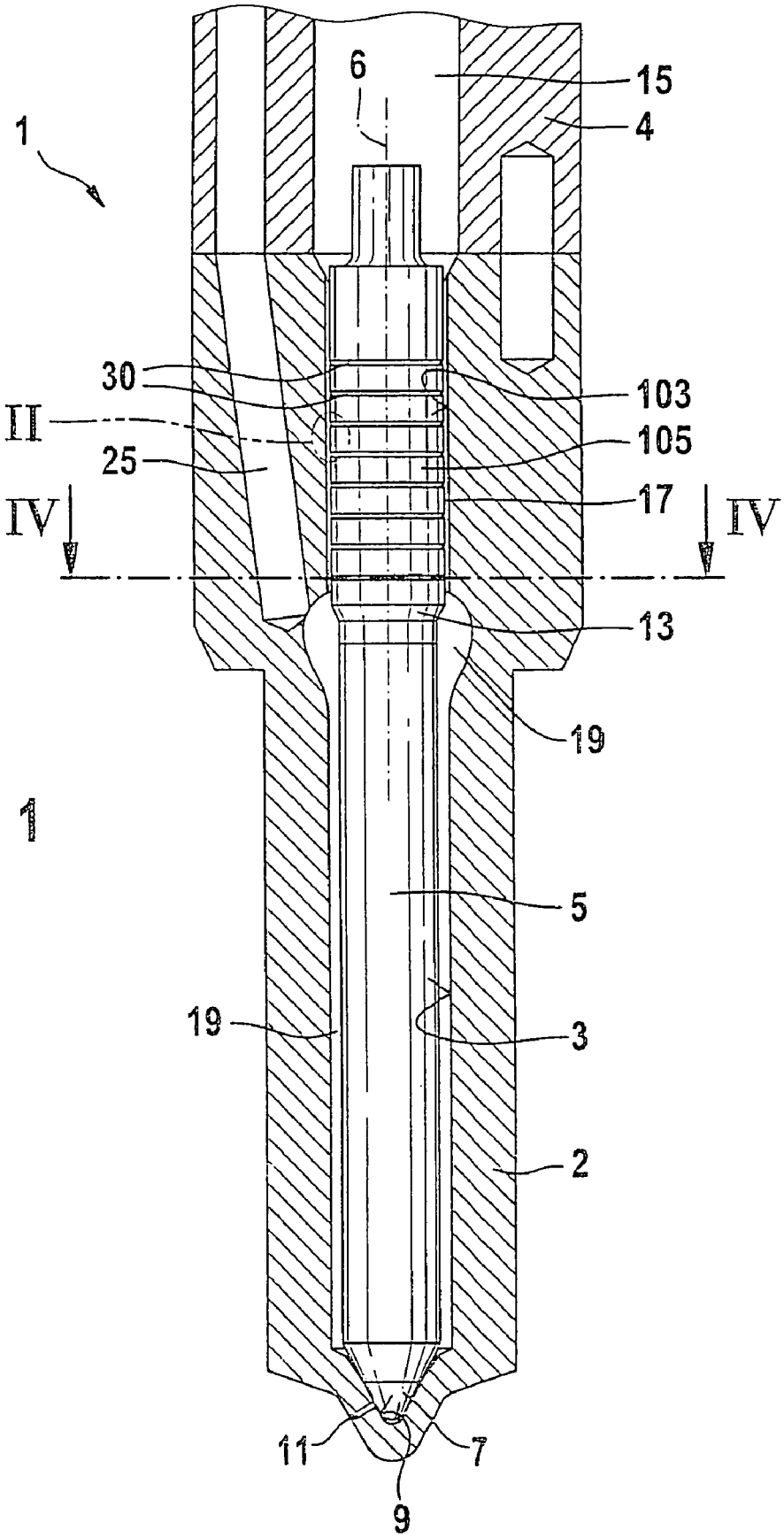
FIG. 1 is longitudinal sectional view of a fuel injection valve for internal combustion engines

In FIG. 1, a fuel supply system of the invention is shown as a fuel injection valve having a housing 1 including a valve body 2 and a valve holder body 4, which contact one another and are pressed against one another by a device not shown in the drawing. A bore 3 is embodied in the valve body 2 and is closed on its end toward the combustion chamber by an essentially conical valve seat 9. In the valve seat 9, at least one injection opening 11 is embodied, which connects the bore 3 with the combustion chamber of the engine. A pistonlike element in the form of a valve needle 5 is disposed in the bore 3; the valve needle 5 has a longitudinal axis 6 and is guided sealingly in a guide region 103 of the bore 3 by a guide portion 105. The valve needle 5 tapers toward the valve seat 9, forming a pressure shoulder 13, and on its end toward the combustion chamber, it changes over into an essentially conical valve sealing face 7, which cooperates with the valve seat 9. The cooperation here is such that when the valve sealing face 7 is in contact with the valve seat 9, the injection opening 11 is closed toward the bore 3, while when the valve sealing face 7 is lifted from the valve seat 9, the injection opening 11 is opened. As a result of a radial widening of the bore 3, a first fuel-filled chamber 19 is disposed at the level of the pressure shoulder 13; it is embodied as a pressure chamber in the valve body 2, and it continues in the form of an annular conduit, surrounding the valve needle 5, as far as the valve seat 9. The pressure chamber 19 can be filled with fuel at high pressure here via an inflow conduit 25 that extends within the valve body 2 and the valve holder body 4.

On the end remote from the combustion chamber, the bore 3 adjoins a second fuel-filled chamber 15, embodied in the valve holder body 4; in this exemplary embodiment, this chamber is embodied as a leak fuel chamber. The leak fuel chamber 15 communicates constantly with a leak fuel system, which is not shown in the drawing and which assures that the leak fuel chamber 15 is always pressure-relieved. At least intermittently, there is accordingly a great pressure difference between the first chamber 19, embodied as a pressure chamber, and the second chamber 15, embodied as a leak fuel chamber. Between the valve needle 5 and the wall of the bore 3, an annular gap 17 remains, through which a certain, severely throttled fuel flow takes place from the pressure chamber 19 into the leak fuel chamber 15. As a result, a fuel lubricating film forms in the annular gap 17, and the valve needle 5 slides on this film. In the pressure chamber 19, a fuel pressure of 150 MPa and more can be achieved, while in the leak fuel chamber 15, a pressure essentially equivalent to atmospheric pressure always prevails.

Figure 2:
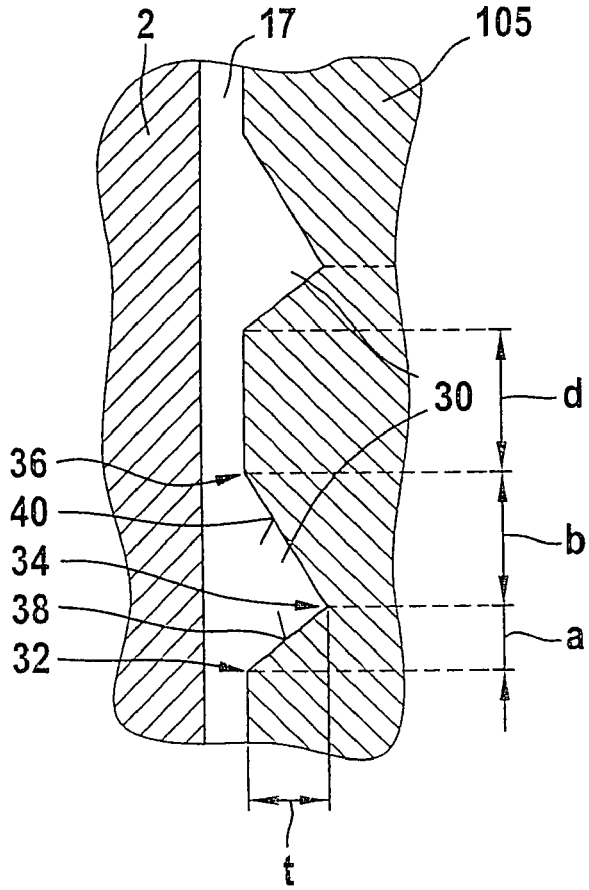
FIG. 2 is an enlargement of FIG. 1, in the detail marked II.

In the guide portion 105 of the valve needle 5, there are recesses 30, which in the form of annular grooves encompass the entire circumference of the valve needle 5. FIG. 2 shows an enlargement of the detail marked II in FIG. 1; in FIG. 2, both the valve body 2 and the valve needle 5, or its guide portion 105, are shown in section. As can be seen from FIG. 2, the recess 30 has a V-shaped cross section, which is formed by a first flank 38 and a second flank 40. The first flank 38 is shorter than the second flank 40, so that the first flank 38 forms a larger angle with the longitudinal axis 6 of the valve needle 5 than does the second flank 40. The first flank 38 and the second flank 40 meet at an apex line 34, at which the recess 30 has the greatest depth t. The apex line 34 can be embodied with a sharp edge or in rounded fashion.

In the direction of the longitudinal axis 6, the first flank 38 has a length a and the second flank has a length b, and the recesses 30 have a spacing d from one another. The ratio of a to b can be varied within wide ranges, in order to adapt the lubricating properties of the recesses 30 to the surfaces of the bore wall 3 and the valve needle 5 or to the size of the annular gap 17. At the transition from the guide portion 105 to the first flank 38, a first transition edge 32 is formed, and at the transition from the guide portion 105 to the second flank 40, a second transition edge 36 is also formed. To optimize the lubricating properties of the recesses 30, the first transition edge 32, oriented toward the pressure chamber 19, is embodied as a sharp-edged transition that is not rounded. In contrast, the second transition edge 36 is embodied in rounded fashion. As a result, the lubricating properties of the recess 30 can be optimized, which can be proven both by simulation and experimentation.

Figure 3:
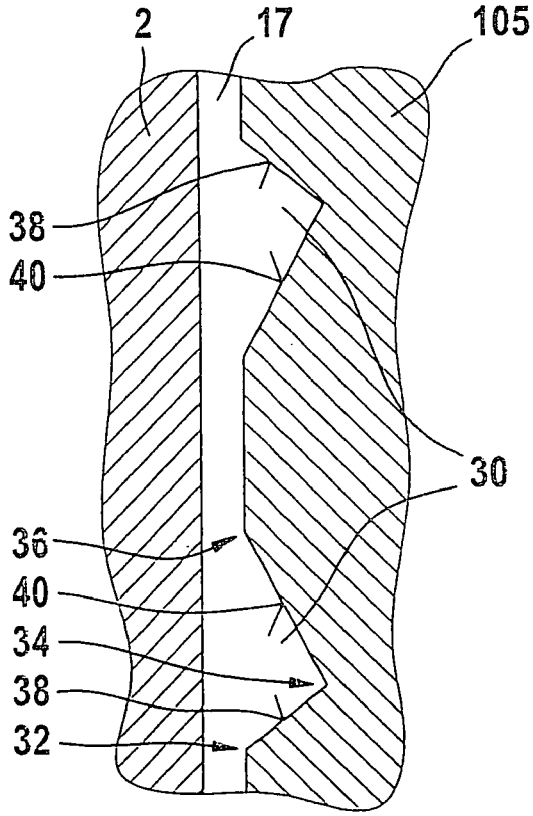
FIG. 3 the same detail as FIG. 2, for a further exemplary embodiment.

In FIG. 3, a further exemplary embodiment of the recesses 30 is shown. In their dimensions and in the embodiment of the first flank 38 and second flank 40, the recesses 30 correspond to the recesses in FIG. 2, but the adjacent recesses 30 have a different orientation. That is, in one recess 30, the first shorter flank 38 is oriented toward the pressure chamber 19, while in the adjacent recess 30 it is oriented away from the pressure chamber 19. This kind of alternating arrangement of recesses 30 is advantageous especially whenever the pressure difference from the first chamber 19 to the second chamber 15 is not very great. Once again, the first transition edge 32 here is embodied with sharp edges, while the second transition edge 36 is rounded.

As already noted, the dimensions a and b of the first flank 38 and second flank 40, respectively, can be varied within wide limits. Provision can also be made for setting the axial length a of the first flank 38 equal to 0, so that the first flank 38 is disposed in a radial plane of the longitudinal axis 6 of the valve needle 5. It can also be provided that the flanks 38 and 40 are not straight but instead assume a convex or concave curvature, which may be advantageous under certain conditions.

The dimensions of the recesses 30 are as follows: The axial lengths of the flanks 38 and 40 in the direction of the longitudinal axis 6 of the valve needle 5 are each from 0.03 to 1 mm, preferably from 0.02 to 0.1 mm. The depth t of the recesses 30 is less than 0.1 mm, preferably being from 0.001 to 0.04 mm. The spacing d of the recesses 30 from one another is from 0.05 to 1 mm.

Figure 4:
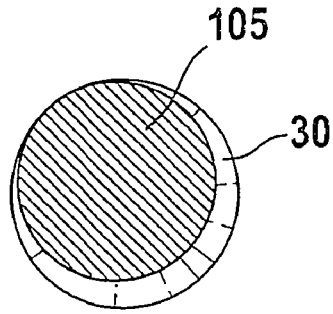
FIGS. 4, 5, 6 and 7, are cross sectional views of a valve need of the type shown in FIG. 1 and taken along the line IV—IV of various exemplary embodiments.
Figure 5:
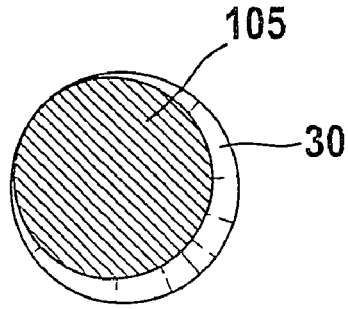
Figure 6:
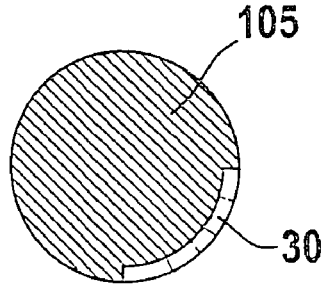
Figure 7:
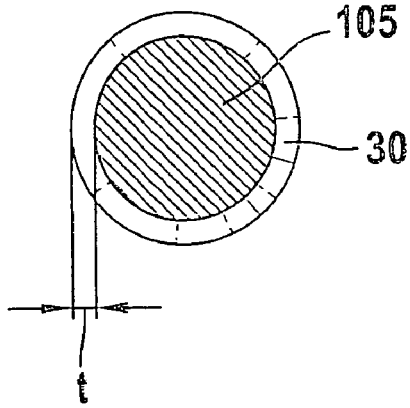

It can also be provided that the recesses 30 are not embodied as annular grooves that surround the entire circumference of the pistonlike element, which is embodied here as the valve needle 5, but instead encompass only part of the circumference. It can also be provided that the depth t of the recesses 30 varies with the circumference. One exemplary embodiment of this kind is shown in FIG. 4, where a cross section through the valve needle 5 is shown, taken along the line IV—IV of FIG. 1. The recess 30 here has a depth of 0 at one point, and the depth of the recess 30 increases over the circumference until it assumes a maximum value on the opposite side of the valve needle 5. Another example is shown in FIG. 5, where the recess 30 has a crescent-shaped contour in cross section, so that in this case once again the depth t ranges from 0 to a maximum value. FIG. 6 shows a further exemplary embodiment of the recess 30, in which the recess 30 extends over only approximately ¼ of the circumference. However, it has a constant depth t. If a plurality of recesses 30 are provided on the valve needle 5, and if they each cover only part of the circumference of the guide portion 105 of the valve needle 5, then these recesses 30 may be distributed over the circumference of the guide portion 105. FIG. 7 shows the cross section of the guide portion 105 of the valve needle 5 for a recess 30 embodied as an annular groove that has the same depth t over the entire circumference.

The described forms of the recesses 30 can be embodied either on the pistonlike element 5, that is, its guide portion 105, or on the inner wall of the bore 3. It can also be provided that such structuring of the recesses be provided on both faces, that is, both on the inside of the bore 3 and on the guide face 105 of the pistonlike element 5. It can also be provided that the recesses 30 embodied as grooves not extend exactly in the tangential direction of the pistonlike element 5, but rather at a more or less large angle to the longitudinal axis of the pistonlike element 5, such as 5° to 10°.

Besides the embodiment of recesses 30 according to the invention on valve needles of fuel injection valves, it can also be provided that such recesses be embodied on other pistonlike elements that are guided in a bore and in which the friction in the bore is to be reduced. It is especially advantageous to embody such recesses whenever the first and second chamber filled with fuel or some other liquid have a pressure markedly different from one another.

The foregoing relates to preferred exemplary embodiment of the invention, it being understood that other variants and embodiments thereof are possible within the spirit and scope of the invention, the latter being defined by the appended claims.

We claim:

1. A fuel supply system for an internal combustion engine, comprising a housing (1) in which a pistonlike element (5) is disposed longitudinally displaceably in a bore (3), the pistonlike element (5) having a guide portion (105) with a guide surface, which guide surface sealingly guides the pistonlike element, first and second fuel-filled chambers (19) and (15) adjoining the guide portion (105) one at each end thereof, and at least one recess (30) in the guide surface extending over at least part of the circumference of the pistonlike element (5) and having a cross section which is asymmetrical in the longitudinal direction of the pistonlike element (5).

2. The fuel supply system of claim 1, wherein the depth of the recess (30) varies over the circumference of the pistonlike element (5).

3. The fuel supply system of claim 2, wherein the fuel supply system is a fuel injection valve.

4. The fuel supply system of claim 1, wherein the depth (t) of the at least one recess is less than 0.1 mm.

5. The fuel supply system of claim 4, wherein the depth (t) of the recess is from 0.001 to 0.04 mm.

6. The fuel supply system of claim 1, wherein in the first chamber (19), at least intermittently, a higher pressure prevails than in the second chamber (15).

7. The fuel supply system of claim 6, wherein the pressure difference between the first chamber (19) to the second chamber (15) is at least intermittently more than 50 MPa.

8. The fuel supply system of claim 6, wherein the fuel supply system is a fuel injection valve.

9. The fuel supply system of claim 1, wherein the fuel supply system is a fuel injection valve.

10. The fuel supply system of claim 9, wherein the pistonlike element is a valve needle (5).

11. The fuel supply system of claim 1, characterized in that the first chamber is a pressure chamber (19) which can be filled with fuel at high pressure, and the second chamber is a leak fuel chamber (15) communicating with a leak fuel device.

12. A fuel supply system for an internal combustion engine, comprising a housing (1) in which a pistonlike element (5) is disposed longitudinally displaceably in a bore (3), the pistonlike element (5) having a guide portion (105) with a guide surface, which guide surface sealingly guides the pistonlike element, first and second fuel-filled chambers (19) and (15) adjoining the guide portion (105) one at each end thereof, and at least one recess (30) in the guide surface extending over at least part of the circumference of the pistonlike element (5) and having a cross section which is asymmetrical in the longitudinal direction of the pistonlike element (5), wherein the at least one recess (30) has a V-shaped cross section, as a result of which a first flank (38) and a second flank (40) are formed, and wherein the first flank (38) is shorter than the second flank (40).

13. The fuel supply system of claim 12, wherein a plurality of said recesses (30) are embodied on the pistonlike element (5), and wherein in succession, for each two recesses, the longer flanks (40) and the shorter flanks (38) are adjacent to one another.

14. The fuel supply system of claim 13, wherein the flanks (38; 40) have a length in the longitudinal direction of the pistonlike element (5) of from 0.03 mm to 1 mm.

15. The fuel supply system of claim 12, wherein the transition from the surface of the pistonlike element (5) to the shorter flank (38) of the recess (30) is embodied with a sharp edge and the transition from the surface of the pistonlike element (5) to the longer flank (40) is rounded.

16. The fuel supply system of claim 15, wherein the flanks (38; 40) have a length in the longitudinal direction of the pistonlike element (5) of from 0.03 mm to 1 mm.

17. The fuel supply system of claim 15, wherein the fuel supply system is a fuel injection valve.

18. The fuel supply system of claim 12, wherein the flanks (38; 40) have a length in the longitudinal direction of the pistonlike element (5) of from 0.03 mm to 1 mm.

19. The fuel supply system of claim 12, wherein the fuel supply system is a fuel injection valve.

* * * * *